US006490902B2

(12) United States Patent
Sclippa

(10) Patent No.: US 6,490,902 B2
(45) Date of Patent: Dec. 10, 2002

(54) COMPACT TWO-LINE ROD-ROLLING STAND

(75) Inventor: Ferruccio Sclippa, Tricesimo (IT)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/076,054

(22) Filed: Feb. 14, 2002

(65) Prior Publication Data

US 2002/0162376 A1 Nov. 7, 2002

(30) Foreign Application Priority Data

Feb. 15, 2001 (IT) ..... PN01A0012

(51) Int. Cl.[7] ..... B21B 35/02
(52) U.S. Cl. ..... 72/235; 72/249
(58) Field of Search ..... 72/235, 249, 235 F, 72/249 F

(56) References Cited

U.S. PATENT DOCUMENTS

| | | | | | |
|---|---|---|---|---|---|
| RE28,107 | E | * | 8/1974 | Wilson et al. | 72/235 |
| 3,930,395 | A | * | 1/1976 | Bretschneider et al. | 72/225 |
| 4,182,147 | A | * | 1/1980 | Brauer et al. | 72/224 |
| 4,537,055 | A | * | 8/1985 | Woodrow et al. | 248/676 |
| 4,807,458 | A | * | 2/1989 | Buch et al. | 72/235 |
| 5,027,632 | A | * | 7/1991 | Pong | 72/204 |
| 6,161,412 | A | * | 12/2000 | Hogg et al. | 72/226 |

FOREIGN PATENT DOCUMENTS

| | | | |
|---|---|---|---|
| DE | 40 09 861 | | 10/1991 |
| GB | 1128157 | * | 9/1968 |
| JP | 60 130401 | | 7/1985 |

* cited by examiner

*Primary Examiner*—Allen Ostrager
*Assistant Examiner*—John Goetz
(74) *Attorney, Agent, or Firm*—Herbert Dubno; Andrew Wilford

(57) ABSTRACT

A two-line roll stand has a frame, an upper shaft on the frame, and two lower shafts on the frame spaced horizontally from each other below the upper shaft and forming with the upper shaft an isosceles triangle. Identical drive units each have a pair of rolls and gearing connected to the respective rolls. The lower shafts each carry three drive units and the upper shaft carries at least four of the drive units. The drive units of the lower shafts define a pair of roll lines spaced below and symmetrically flanking the upper shaft. The upper-shaft drive units are aligned on the lines with the rolls of the respective lower-shaft drive units. A single motor has an output directly connected to drive gears on the shafts for synchronously rotating all the shafts and thereby rotating all the rolls via the respective bevel gears and the respective drive units.

8 Claims, 3 Drawing Sheets

COMPACT TWO-LINE ROD-ROLLING STAND

FIELD OF THE INVENTION

The present invention relates to a roll stand. More particularly this invention concerns a compact rod-rolling stand with two rolling lines.

BACKGROUND OF THE INVENTION

In the hot-rolling of rod, typically immediately after it is cast as a billet or bloom, it is known to use a roll stand having a succession of pairs of rolls, vertical pairs alternating with horizontal pairs, that serve to reduce the cross-sectional size of the incoming workpiece to the desired small rod cross section.

With small calibers it is understood that the procedure is quite expensive, both because of the process time as well as due to its complexity. Thus in order to insure acceptable productivity, the rolling speed must always be increased, speeds of 100 m/sec being exceeded by far.

The solution is the split-roll procedure such as shown in Japanese 60-130,401. This produces two strands from a single incoming strip and passes each of the individual strands through a series of roll pairs, with each succeeding roll pair oriented 90° offset from the preceding one. Similarly it is possible to expand this method and reduce a flat strip to four or more strands that are individually rolled. Thus, starting with a square-section bloom or billet some 160 mm on a side coming straight from the furnace, it is possible to produce rod at a rate of for example 37 ton/hour.

It is also possible to use horizontally arranged winding machines, for instance of the Edembor™ type to produce rod or wire with a diameter smaller than 5.5 mm by means of several rolling lines.

Such use of multiple rolling lines greatly increases the complexity and also the overall size of the treatment plant.

OBJECTS OF THE INVENTION

It is therefore an object of the present invention to provide an improved dual-line rolling stand.

Another object is the provision of such an improved dual-line rolling stand which overcomes the above-given disadvantages, that is which is quite compact and of relatively simple and inexpensive construction.

A further object is to provide a roll stand which is particularly easy to service and repair.

SUMMARY OF THE INVENTION

A two-line roll stand has according to the invention a frame, an upper shaft on the frame, and two lower shafts on the frame spaced horizontally from each other below the upper shaft and centered on axes forming with an axis of the upper shaft an isosceles triangle. A plurality of identical drive units each have a pair of rolls and gearing connected to the respective rolls. The lower shafts each carry at least two of the drive units and the upper shaft carries at least four of the drive units. Respective bevel gears on the shafts are connected to the gearing of the drive units. The drive units of one of the lower shafts are tipped outward away from the drive units of the other lower shaft with the rollers of the lower-shaft drive units defining a pair of roll lines spaced below and symmetrically flanking the upper shaft. The upper-shaft drive units are tipped downward with the rollers of each upper-shaft drive unit aligned on the lines with the rolls of the respective lower-shaft drive units. A single motor has an output directly connected to drive gears on the shafts for synchronously rotating all the shafts and thereby rotating all the rolls via the respective bevel gears and the gearing of the respective drive units.

Thus this system uses identical drive units so as to simplify servicing the machine. Furthermore the use of three shafts oriented on a triangle with interleaved pairs of rolls makes the stand very compact, in particular longitudinally parallel to the roll lines.

According to the invention the lower shafts each carry the same predetermined number of the drive units and the upper shaft carries twice as many of the drive units. In one preferred embodiment each lower shaft carries three of the drive units and the upper shaft carries six of the drive units. The longitudinal spacing parallel to the lines between the upper-shaft drive units is half a longitudinal spacing between the lower-shaft drive units.

Furthermore in accordance with the invention seen in vertical section the axes of the shafts form with the lines a substantially equilateral pentagon.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
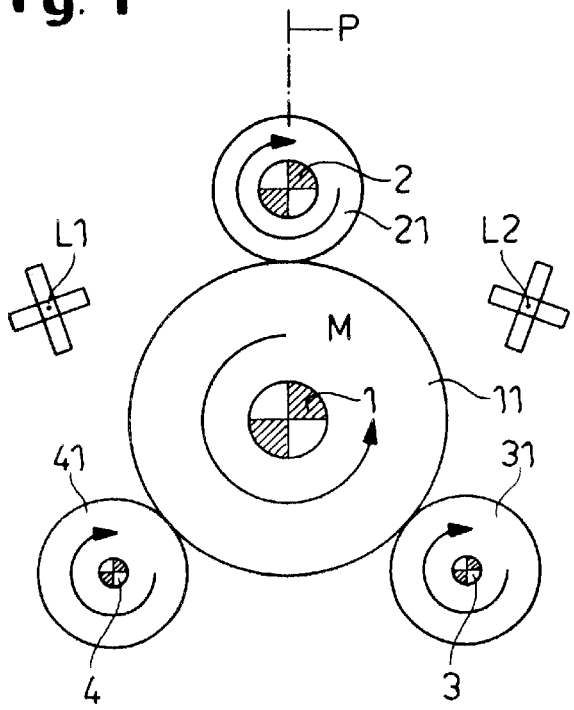
FIG. 1 is a largely diagrammatic vertical section through the roll stand according to the invention.
Figure 2:
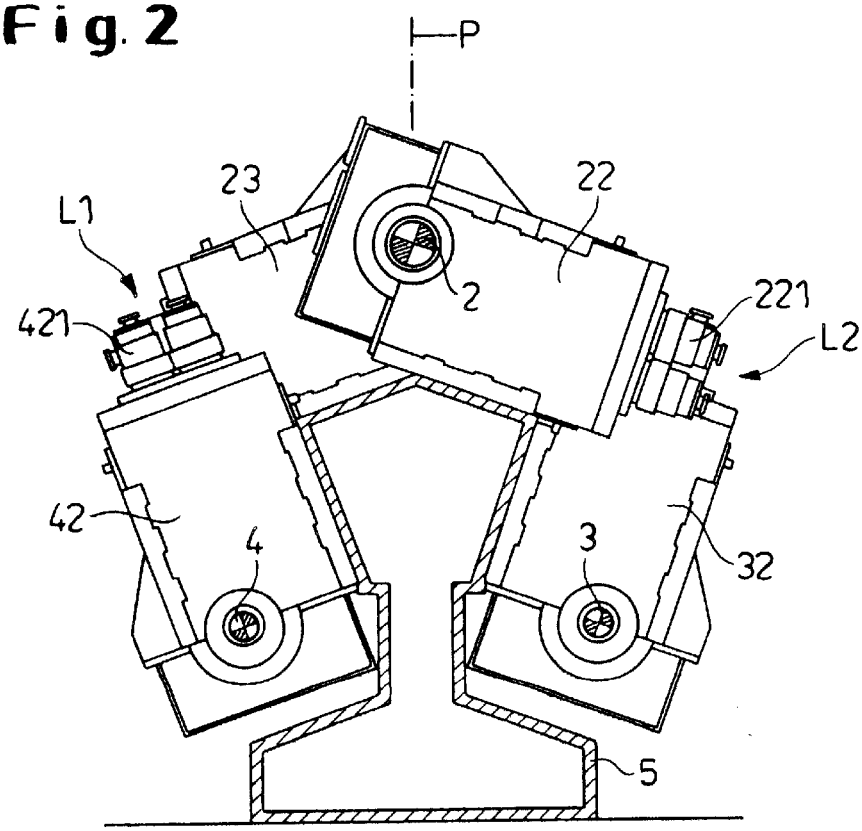
FIG. 2 is a vertical section through the roll stand.
Figure 3:
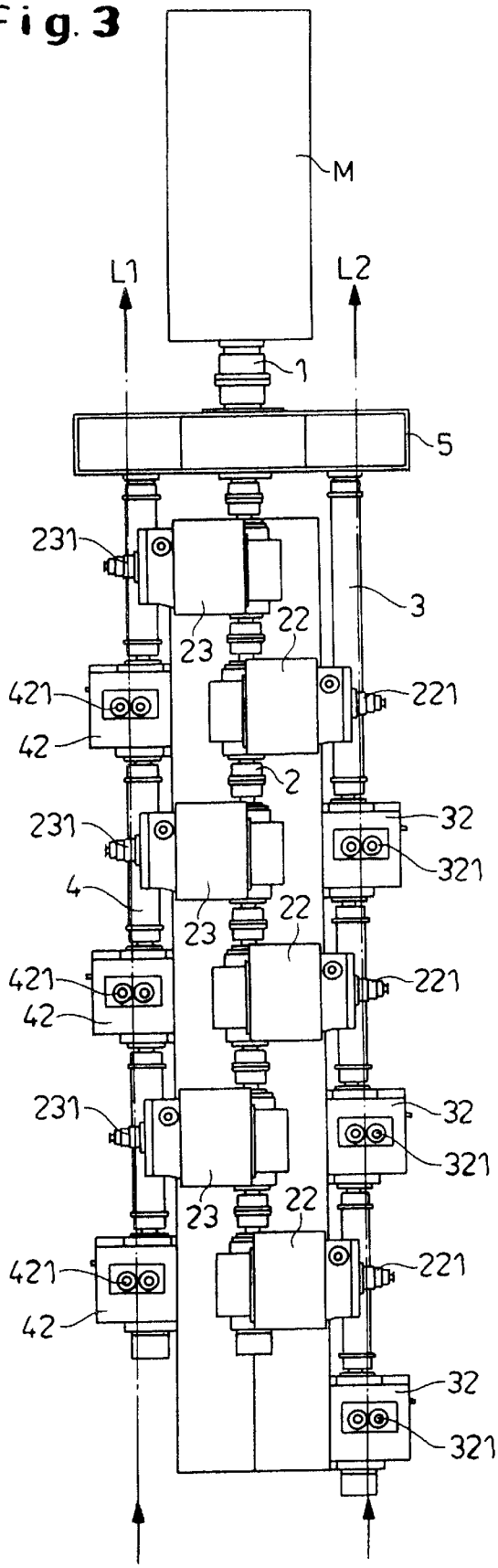
FIG. 3 is a top view of the roll stand.
Figure 4:
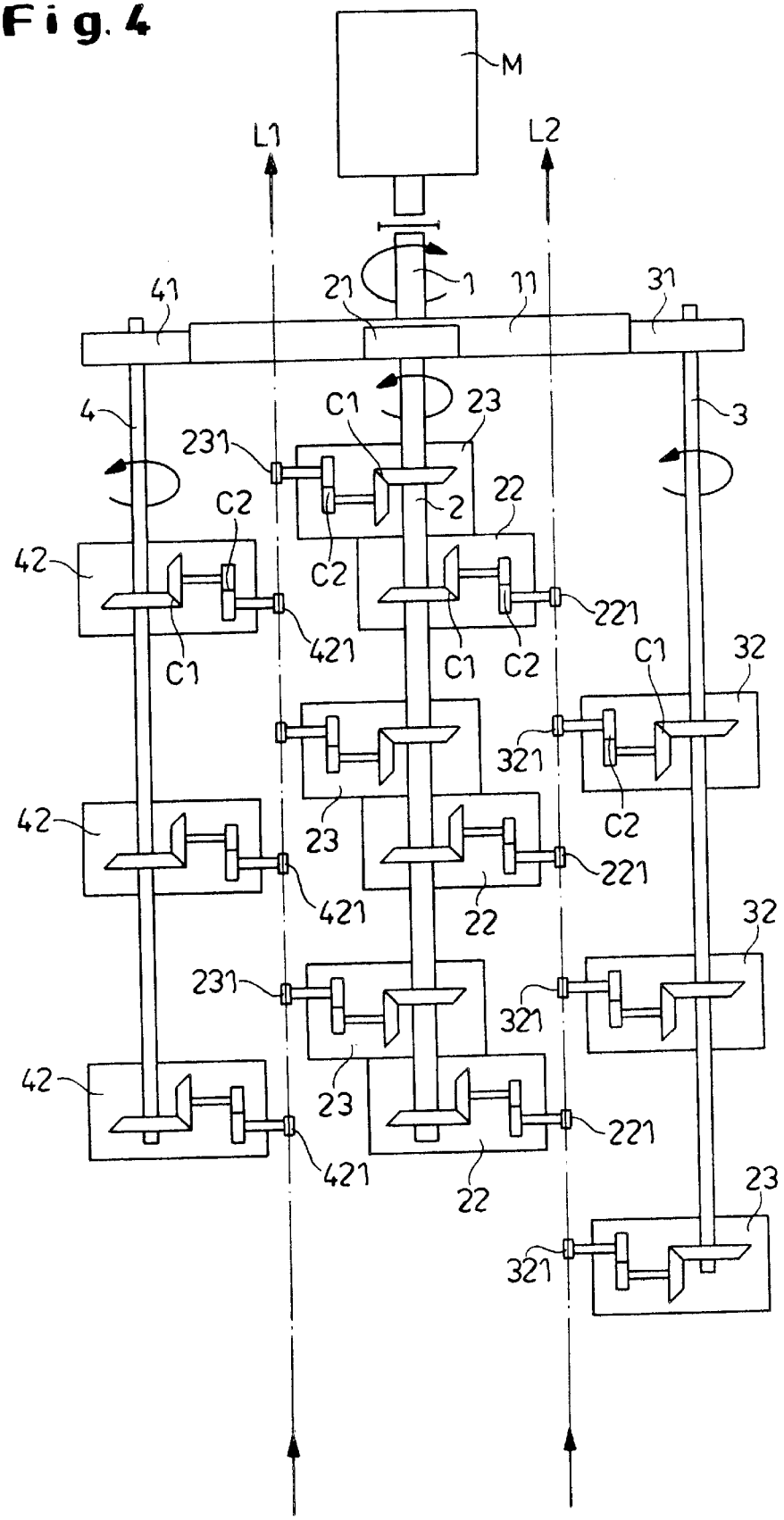
FIG. 4 is a diagrammatic view illustrating the drive for the roll stand.

As seen in FIGS. 1 through 3 a roll stand according to the invention has a stationary elongated frame 5 on which are supported an upper horizontal shaft 2 and two lower shafts 3 and 4 whose axes define as seen in a vertical section an isosceles triangle symmetrical to a vertical plane P passing through the axis of the upper shaft 2 and midway between the axes of the lower shafts 3 and 4. A motor M mounted at one end of the frame it has an output shaft 1 that drives a gear or gears 11 that meshes with three identical gears 21, 31, and 41 carried on the respective shafts 2, 3, and 4 so as to rotate them all at the same speed and in the same direction (see arrows in FIG. 1).

The roll stand has two processing lines L1 and L2 that lie above and slightly outward of the lower shafts 3 and 4 and below and symmetrically flanking the upper shaft 2. The shafts 3 and 4 are each provided with three respective drive units 32 and 42 carrying respective roll pairs 321 and 421. The upper shaft 2 carries for each of the two lines L1 and L2 three respective drive units 22 and 23 for a total of six drive units 22 and 23. The upper-shaft drive units 22 and 23 carry respective roll pairs 221 and 231. The three left-hand drive units 23 of the shaft 2 are interleaved with the drive units 42 and the left-hand upper-shaft roll pairs 231 are aligned on the line L1 with the lower-shaft roll pairs 421. Similarly the three right-hand drive units 22 are interleaved with the drive units 32 and the right-hand upper-shaft roll pairs 221 are aligned on the line L2 with the lower-shaft roll pairs 321. The axes of the shafts 2, 3, and 4 form as seen in a vertical section with the centers of the rolling lines L1 and L2 an equilateral pentagon.

The drive units 22, 23, 32, and 42 are all identical and each comprise a pair of bevel gears C1 one of which is carried on the respective shaft 2, 3, and 4 and step-down gearing C2 connected between the respective bevel gears C1 and the respective rolls 221, 231, 321, and 421. The lower-shaft drive units 32 and 42 are tipped out so that the respective rolls 321 and 421 rotate about respective upright axes that extend at a small acute angle of about 25° to the vertical and the upper-shaft drive units 22 and 23 are tipped down somewhat from the shaft 2 by the same angle so that the respective rolls 221 and 231 rotate about generally horizontal axes forming the same small acute angle to the horizontal and perpendicular to the rotation axes of the respective lower-shaft rolls 321 and 421.

Thus the drive units 22, 23, 32, and 42 and the respective rolls 221, 231, 321, and 421 are interchangeable modules. This makes servicing of the machine extremely easy. Furthermore the interleaving of the right- and left-hand drive units 32 and 42 with the upper-shaft units 22 and 23 makes the stand longitudinally, that is parallel to the lines L1 and L2, very compact. Only a single drive motor M is used so that perfectly synchronous operation of the system is certain.

I claim:

1. A two-line roll stand comprising:

a frame;

an upper shaft on the frame;

two lower shafts on the frame spaced horizontally from each other below the upper shaft and centered on axes forming with an axis of the upper shaft an isosceles triangle;

at least four identical drive units each having a pair of rolls, the lower shafts each carrying one of the drive units and the upper shaft carrying two of the drive units, the lower-shaft drive units being tipped outward away from each other with the respective rollers defining a pair of roll lines spaced below and symmetrically flanking the upper shaft and the upper-shaft drive units being tipped downward with the rollers of each upper-shaft drive unit being aligned on the lines with the rolls of the respective lower-shaft drive units; and drive means for synchronously rotating all the shafts and thereby rotating all the rolls via the respective drive units.

2. The two-line roll stand defined in claim 1 wherein each lower shaft carries three of the drive units and the upper shaft carries six of the units.

3. The two-line roll stand defined in claim 1 wherein seen in vertical section the axes of the shafts form with the lines a generally equilateral pentagon.

4. A two-line roll stand comprising:

a frame;

an upper shaft on the frame;

two lower shafts on the frame spaced horizontally from each other below the upper shaft and centered on axes forming with an axis of the upper shaft an isosceles triangle;

respective drive gears on the shafts;

a plurality of identical drive units each having a pair of rolls and gearing connected to the respective rolls, the lower shafts carrying at least two of the drive units and the upper shaft carrying at least four of the drive units;

respective bevel gears on the shafts connected to the gearing of the drive units, the drive units of one of the lower shafts being tipped outward away from the drive units of the it other lower shaft with the rollers of the lower-shaft drive units defining a pair of roll lines spaced below and symmetrically flanking the upper shaft, the upper-shaft drive units being tipped downward with the rollers of each upper-shaft drive unit being aligned on the lines with the rolls of the respective lower-shaft drive units; and drive means including a single motor having an output directly connected to the drive gears for synchronously rotating all the shafts and thereby rotating all the rolls via the respective bevel gears and the gearing of the respective drive units.

5. The two-line roll stand defined in claim 4 wherein the lower shafts each carry the same predetermined number of the drive units and the upper shaft carries twice as many of the drive units.

6. The two-line roll stand defined in claim 5 wherein each lower shaft carries three of the drive units and the upper shaft carries six of the drive units, a longitudinal spacing parallel to the lines between the upper-shaft drive units being generally half a longitudinal spacing between the lower-shaft drive units.

7. The two-line roll stand defined in claim 4 wherein seen in vertical section the axes of the shafts form with the lines a pentagon.

8. The two-line roll stand defined in claim 7 wherein the pentagon is substantially equilateral.

* * * * *